US007393621B2

(12) United States Patent
Lee et al.

(10) Patent No.: US 7,393,621 B2
(45) Date of Patent: Jul. 1, 2008

(54) TONER COMPOSITION FOR ELECTROPHOTOGRAPHY IMAGE FORMING APPARATUS

(75) Inventors: Duck-hee Lee, Seoul (KR); Sang-deok Kim, Seoul (KR); Seok-hoon Choi, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 421 days.

(21) Appl. No.: 11/147,377

(22) Filed: Jun. 8, 2005

(65) Prior Publication Data

US 2005/0277041 A1 Dec. 15, 2005

(30) Foreign Application Priority Data

Jun. 10, 2004 (KR) ..... 10-2004-0042568

(51) Int. Cl.
*G03G 9/00* (2006.01)

(52) U.S. Cl. ..... 430/108.6; 430/108.7

(58) Field of Classification Search ..... 430/108.6, 430/108.7

See application file for complete search history.

(56) References Cited

U.S. PATENT DOCUMENTS 6,025,107 A * 2/2000 Sekiguchi et al. ..... 430/108.4
2003/0210930 A1 11/2003 Nakai et al.
2005/0058924 A1* 3/2005 Miyakawa ..... 430/108.6

FOREIGN PATENT DOCUMENTS

| | | |
|---|---|---|
| JP | P01-229266 | 9/1989 |
| JP | 07-219265 | 8/1995 |
| JP | 2000-131952 | 5/2000 |
| JP | 2000-267341 | 9/2000 |
| JP | 2001-109185 | 4/2001 |
| JP | 2003-255609 | 9/2003 |
| KR | 1987-10421 | 2/2000 |
| KR | 1997-28881 | 5/2000 |

OTHER PUBLICATIONS

Korean Office Action for corresponding to Korean Patent Application No. 10-2004-0042568 dated Feb. 16, 2006.
Japanese Office Action for corresponding Japanese Patent Application No. 2005-171278 dated Dec. 5, 2006.

* cited by examiner

*Primary Examiner*—Mark A Chapman
(74) *Attorney, Agent, or Firm*—Staas & Halsey LLP

(57) ABSTRACT

A toner composition for an electrophotography image forming apparatus includes toner particles and external additives. The toner particles include a colorant, a charge control agent and a release agent with binder resins. The external additives include a first silica having an opposite polarity to the toner particles, a second silica having the same polarity as the toner particles, a sodium titanate having the same polarity as the toner particles, and an aluminum oxide having the same polarity as the toner particles.

19 Claims, 1 Drawing Sheet

TONER COMPOSITION FOR ELECTROPHOTOGRAPHY IMAGE FORMING APPARATUS

CROSS-REFERENCE TO RELATED APPLICATIONS

This application claims the benefit of Korean Patent Application No. 2004-42568 filed Jun. 10, 2004, in the Korean Intellectual Property Office, the disclosure of which is incorporated herein by reference.

BACKGROUND OF THE INVENTION

1. Field of the Invention

The present invention relates to a toner composition. More particularly, the present invention relates to a toner composition containing an external additive and used in an electrophotography image forming apparatus such that a stable charge and a stable charge distribution are retained in spite of environmental variation and periodic variation due to a long use of image printing.

2. Description of the Related Art

As an electrophotography image forming apparatus, there are, for example, a facsimile, a laser beam or light emitting diode (LED) printer, a laser beam copier, a variety of electrophotography output apparatuses and the like. Such an electrophotography image forming apparatus includes a dry type electrophotography image forming apparatus using a dry toner and a wet type electrophotography image forming apparatus using a wet toner. The present invention mainly relates to a dry type electrophotography image forming apparatus, although it is not strictly limited thereto.

A dry toner generally includes a binder resin which contains a colorant, a charge control agent, and other additives. The additives may be classified into internal additives added to an inside of the toner particle and external additives added to a surface of the toner particle, and are generally added to enhance the functionality of the toner.

The colorants may be classified into dye type colorants and pigment type colorants. The pigment type colorants are generally used because they are advantageous with respect to thermal stability and resistance against light compared with the dye type colorants.

The charge control agents are added to control a charge of the toner particle. The charge control agents are added differently depending on the charge type, i.e., positive (+) or negative (−) type of the toner particles.

Among the functional additives added to the toner, the release agent is utilized to enhance the release property. The release agent enhances the release property between the roller and the toner when a toner image is transferred onto and fixed on a record medium, thus preventing toner offset and also preventing the record medium from adhering to the roller due to the toner and generating a jamming phenomenon.

FIG. 1 schematically illustrates a dry type electrophotography image forming apparatus. In particular, FIG. 1 illustrates a dry type electrophotography image forming apparatus using a non-contact developing method. Referring to FIG. 1, after a photosensitive body 100 is charged using a charge unit 600, an image is exposed using a laser scanning unit 900 to form a latent image on the photosensitive body 100. Toner 400 is fed to a developing roller 200 by a supply roller 300. The toner fed to the developing roller 200 forms a thin and uniform toner layer on a surface of the developing roller 200 by a toner layer control unit 500, and at the same time, is contacted by both the developing roller 200 and the toner layer control unit 500. The toner that has passed through a member of the toner layer control unit 500 is developed in the form of a latent image formed on the photosensitive body 100. The developed toner is transferred onto a record medium by a transfer roller (not shown) and is then fused by a fusing unit (not shown). After the transfer of the toner, the toner remaining on the photosensitive body 100 is cleaned off the photosensitive body 100 by a cleaning blade 700. The cleaned off toner 800 is collected in a bin near the cleaning blade 700.

In such a dry type electrophotography image formation, the toner has fine particles which are a few micrometers in size, and is used to form a print image on a record medium. A charge property and flow properties of the toner are highly significant factors controlling quality of the print image. The print image is required to maintain stable quality even after an extended time has elapsed as well as in an initial printing. Also, it is required that the variation in the print image quality be minimized under a condition of an environmental variation. To satisfy the requirements specified above, the toner may include a variety of internal or external additives. By using such internal or external additives, it is possible to control the charge properties and the flow properties of the toner. However, the external additives, which are added for the purposes such as stabilization of a toner charge, prevention of a fog, and enhancement of a development efficiency, have a limitation in improving the image quality. In other words, the external additives have a disadvantage in that a large variation in the toner charge characteristic is generated by an environmental variation. For example, overcharge is easily generated under a low temperature and a low humidity environment. Fog, toner dispersion or the like is generated in a non-image region due to a lowering of charge under a high temperature and a high humidity environment. Also, in an initial stage of the printing, the external additives have a uniform charge and charge distribution, but when external additives are left without any management, the charge is lowered remarkably. Further, when images are printed for a long time, charge is reduced, charge distribution is non-uniform, image concentration is lowered, and fog and toner dispersion are caused.

In particular, to provide the toner with a uniform charge property, it is necessary to form a thin toner layer on the developing roller. However, when a thin toner layer is formed, the toner degenerates due to toner stress, or the development efficiency is abruptly lowered, so that image concentration may be easily decreased. Also, when the toner charge is lowered to improve the decreased development, the fog may be increased or contamination may be caused due to the toner dispersion.

SUMMARY OF THE INVENTION

Therefore, an aspect of the present invention is to provide a toner composition of an electrophotography image forming apparatus, wherein the toner composition contains an external additive having a component ratio to maintain a stable toner charge and a stable charge distribution, suppress occurrence of fog and maintain a constant development characteristic in spite of environmental variation and periodic variation due to image printing for an extended term period.

According to an aspect of the present invention, the present invention provides a toner composition of an electrophotography image forming apparatus, the toner composition comprising toner particles and external additives, the toner particles including a colorant, a charge control agent and a release agent among binder resins, and wherein the external additives comprise a first silica having an opposite polarity to the toner particles, a second silica having a same polarity as the toner particles, a sodium titanate having the same polarity as the toner particles, and an aluminum oxide having the same polarity as the toner particles.

Preferably, the first silica having an opposite polarity to the toner particles has a primary particle size ranging from about 30 nm to about 200 nm and has about 0.1 wt % to about 3.0 wt % with respect to 100 wt % that is a total weight of the toner particles, and the second silica having the same polarity with respect to the toner particles has a primary particle size ranging from about 5 nm to about 200 nm and has about 0.1 wt % to about 6.0 wt % with respect to 100 wt % that is a total weight of the toner particles.

Preferably, the second silica has the same polarity with respect to the toner particles and has a primary particle size ranging from about 5 nm to about 30 nm. The second silica is in an amount of about 0.1 wt % to about 3.0 wt % with respect to 100 wt % that is a total weight of the toner particles, and the second silica has the same polarity with respect to the toner particles and has a primary particle size ranging from about 30 nm to about 200 nm is in an amount of about 0.1 wt % to about 3.0 wt % with respect to 100 wt % that is the total weight of the toner particles.

Preferably, a weight ratio of the second silica having the primary particle size ranging from about 5 nm to about 30 nm with respect to the second silica having the primary particle size ranging from about 30 nm to about 200 nm is less than 4.

Preferably, the sodium titanate having the same polarity as the toner particles has a primary particle size ranging from about 0.05 μm to about 1 μm and has about 0.1 wt % to about 2.0 wt % with respect to 100 wt % that is a total weight of the toner particles.

Preferably, the aluminum oxide having the same polarity with respect to the toner particles has a primary particle size ranging from about 5 nm to about 200 nm and has about 0.1 wt % to about 2.0 wt % with respect to 100 wt % that is a total weight of the toner particles.

Preferably, when the toner particles have a negative (−) polarity, the aluminum oxide is surface-treated by lauryl sulfate. When the toner particles have a positive (+) polarity, the aluminum oxide is preferably surface-treated by di-stearyl di-methyl ammonium chloride.

In the toner composition, the binder resin is present in an amount of from about 80 parts by weight to about 90 parts by weight per 100 parts by weight of the toner, the colorant is present in an amount of from about 1 wt % to about 10 parts by weight per 100 parts by weight of the toner, the charge control agent is present in an amount of from about 0.1 wt % to about 10 parts by weight per 100 parts by weight of the toner, and the wax is present in an amount of from about 1 wt % to about 10 parts by weight per 100 parts by weight of the toner.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of an embodiment, taken in conjunction with the accompanying drawing of which.

DETAILED DESCRIPTION OF THE PREFERRED EMBODIMENTS

Figure 1:
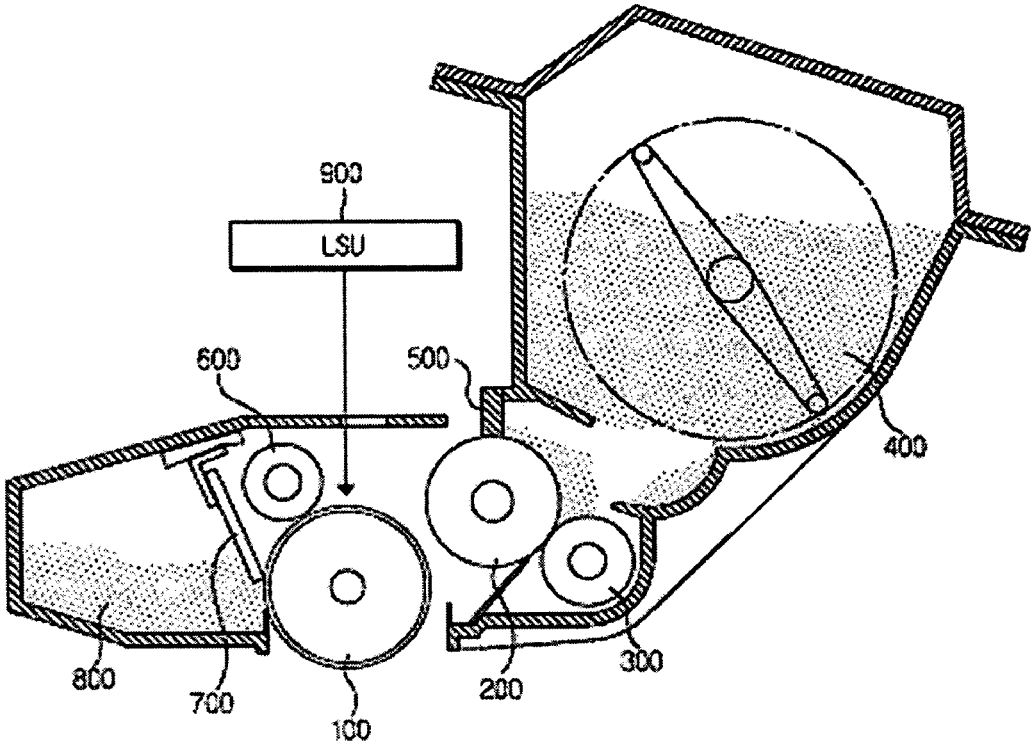
FIG. 1 PRIOR ART
FIG. 1 schematically illustrates a general electrophotography image forming apparatus.

Reference will now be made in detail to an embodiment of the present invention, an example of which is illustrated in the accompanying drawing. The embodiment is described below to explain the present invention by referring to the FIGURE.

The matters defined in the description, such as a detailed construction and elements are provided to assist in a comprehensive understanding of the invention. Thus, it is apparent that the present invention may be carried out without those defined matters. Also, well-known functions or constructions are not described in detail since they would obscure the invention in unnecessary detail.

A toner composition according to an embodiment of the present invention, includes binder resin, toner particles and external additives. The toner particles include a colorant, a charge control agent, and a release agent.

The binder resin used in the toner composition according to an embodiment of the present invention, for example, includes a styrene such as polystyrene and polyvinyl toluene, a single polymer of a derivative of the styrene, a styrene copolymer such as styrene-acryl copolymer, polyethylene, polypropylene, a vinyl chloride-based resin, a polyacrylate, a polymethacrylate, a polyester, a polyacrylonitrile, a melamin resin, an epoxy resin and the like. The binder resin may comprise one or more selected from the binder resins specified above. However, it should be noted that the binder resin that may be used in the toner composition of the present invention is not limited only to the aforementioned binder resin group.

The binder resin generally included in the toner composition is present in an amount of from about 80 weight percent to about 98 weight percent with respect to 100 weight percent that is a total weight of the toner particles.

The general colorants known to those skilled in the art may be used as a colorant for the toner particles of the present invention. In particular, it is preferable that a pigment type colorant exhibiting superior properties in thermal stability and resistance against light is used.

The pigment type colorant that may be used in an embodiment of the present invention, for example, includes: a coloring organic pigment comprising azo-based pigment, a phthalocyanine-based pigment, a basic dye-based pigment, a quinacridone-based pigment, a dioxacin-based pigment and condensation azo-based pigment; a coloring inorganic pigment comprising a salt chromate, a perocyanide, an oxide, a sulfide, a selenite, a sulfate, a silicate, a carbonate, a phosphate, and a metal powder; and a black inorganic pigment including carbon black. The pigment type colorant may comprise one or more selected from the aforementioned pigment type colorants. However, it should be noted that the pigment type colorant that may be used in the toner composition of the present invention is not limited only to the aforementioned binder resin group.

Among the pigments specified above, it is preferable that the organic pigment be used due to environmental pollution and the like.

The organic pigment that may be used in the present invention, for example, includes a blue and/or green pigment including copper phthalocyanine, a metal-free phthalocyanine such as pigment blue (P.B.) 15, 15:1, 15:2, 15:3, 15:4, 15:6, 16, a phthalocyanine having aluminum (Al), nickel (Ni) or vanadium (V) as a core metal, and breezed phthalocyanine polymer/oligomer such as a Si-breezed phthalocyanine; an orange pigment such as P.O. 5, 13, 42, 71, 72 and the like; pigment yellow such as P.Y. 12, 13, 17, 74, 83, 93, 146, 155, 180, 185 and the like; a pigment red such as P.R. 48, 57, 122, 146, 147, 176, 184, 186, 202, 207, 238, 254, 255, 269, 270, 272; and a mixture pigment such as P.V.19/P.R.122 or P.R. 146/147. The toner composition of the present invention may use the above-cited pigments, but is not limited thereto.

It is preferable that the toner composition of the present invention includes the pigment present in an amount of from about 1 wt % to about 10 wt % with respect to 100 wt % that is a total weight of the toner particles. If the amount of the pigment is less than about 1 wt %, a printed image is not definite, whereas if the amount of the pigment is more than about 10 wt %, amounts of components other than the pigment are decreased, which makes it difficult to obtain desired physical properties of the toner.

The charge control agent is added to control a charge of the toner particles.

The charge control agent may have a negative (−) or a positive (+) polarity. The negative charge control agent includes azo-based pigments and compounds of salicylic acid containing a metal element such as Cr, Fe or Zn. The positive charge control agent includes nigrosine compounds, quaternary ammonium salts, triphenylmethane derivative and the like.

Commercially available examples of the charge control agent include NIGROSINE NO1 (made by ORIENT CHEMICALS CO. LTD.), AIZEN SPILON BLACK TRH (made by HODOGAYA CHEMICALS CO. LTD.), T-77 (made by HODOGAYA CHEMICALS CO. LTD.), BONTRON S-34 (made by ORIENT CHEMICALS CO. LTD.), BONTRON E-84 (made by ORIENT CHEMICALS CO. LTD.) and the like.

In the toner composition, the charge control agent is generally present within an amount of from about 0.1 wt % to about 10 wt % per 100 wt % of the toner particles.

Representatives of the release agent include low molecular polyolefins, silicons having a softening point by heating, fatty acid amid, wax and the like. The wax commercially readily available is widely used.

The wax available as the release agent of an embodiment of the present invention, for example, includes carnauba wax, vegetable wax including bayberry wax and animal natural wax including beeswax, shellac wax, and spermaceti wax, mineral wax including montan wax, ozokerite wax, and ceresin wax, synthetic wax including paraffin wax, microcrystalline wax, polyethylene wax, polypropylene wax, acrylate wax, fatty acid wax, silicon wax, polytetrafluoreothyene wax and the like. If desired and necessary, these release agents may be used as a mixture of two or more thereof. However, it should be noted that the release agent that may be used in the toner composition of the present invention is not limited only to only these release agents. Also, in the toner composition, the wax is generally present within an amount of from about 0.1 wt % to about 10 wt % per 100 wt % of the toner particles.

It is preferable that the toner composition of the present invention includes external additives having a predetermined component ratio to maintain a stable toner charge and a stable charge distribution, suppress occurrence of fog and maintain a constant development characteristic besides the basic composition of the toner particles. The external additives include a first silica having an opposite polarity to the toner particles, a second silica having a same polarity as the toner particles, a sodium titanate having the same polarity as the toner particles, and an aluminum oxide having the same polarity as the toner particles.

The first silica having the opposite polarity with respect to the toner particles has a primary particle size ranging from about 30 nm to about 200 nm and is present in an amount of about 0.1 wt % to about 3.0 wt % with respect to 100 wt % that is a total weight of the toner particles. The second silica having the same polarity with respect to the toner particles has a primary particle size ranging from about 5 nm to about 200 nm and is present in an amount of about 0.1 wt % to about 6.0 wt % with respect to 100 wt % that is a total weight of the toner particles.

If the amount of the first silica is less than about 0.1 wt %, it is difficult to anticipate its effect, whereas if the amount of the first silica is more than about 3.0 wt %, the first silica influences the polarity of the toner particles, so that the polarity of the toner particles may be changed, and the distribution of the polarity may be non-uniform.

The terminology 'primary particle' used in the present invention indicates a unit particle of a compound in which polymerization, bonding or the like does not occur.

In the silica, when the primary particle size is approximately above about 30 nm, it is referred to as a 'large particle", and when the primary particle size is less than approximately 30 nm, it is referred to as a 'small particle". The small particle silica is mainly added to enhance the flow property, and the large particle silica is added to enhance the spacer function of the small particle silica and the transfer property of the toner. The first silica having the opposite polarity with respect to the toner particles uses the large particle silica, and the second silica having the same polarity with respect to the toner particles uses only one of the small particle silica and the large particle silica, or may use a mixture thereof without any sorting.

Preferably, the second silica having the same polarity and the primary particle size ranging from about 5 nm to about 30 nm is present in an amount of about 0.1 wt % to about 3.0 wt % with respect to 100 wt % that is a total weight of the toner particles, and the second silica having the same polarity and the primary particle size ranging from about 30 nm to about 200 nm is present in an amount of about 0.1 wt % to about 3.0 wt % with respect to 100 wt % that is the total weight of the toner particles.

It is preferable that a weight ratio of the silica having the primary particle size ranging from about 5 nm to about 30 nm to the silica having the primary particle size ranging from about 30 nm to about 200 nm is less than 4.

The sodium titanate contained in the external additives and having the same polarity as the toner particles has a primary particle size ranging from about 0.05 μm to about 1 μm and is preferably present in an amount of from about 0.1 wt % to about 2.0 wt % with respect to 100 wt % that is a total weight of the toner particles. The sodium titanate is added to enhance the charge properties of the toner particles.

The aluminum oxide having the same polarity as the toner particles has a primary particle size ranging from about 5 nm to about 200 nm and is preferably present in an amount of from about 0.1 wt % to about 2.0 wt % with respect to 100 wt % that is a total weight of the toner particles. The aluminum oxide is added to enhance a dot reproduction property of the toner, cleaning property and the like, and it facilitates control of fog that may occur in a printed image, or the image density, and suppresses occurrence of an image defect such as vertical lines, sport or the like.

When the toner particles have a negative (−) polarity, the aluminum oxide is preferably surface-treated by lauryl sulfate. Since the aluminum oxide has a weak positive property, it is necessary to surface-treat the aluminum oxide such that the aluminum oxide has the negative polarity that is the same as the polarity of the toner particles.

Also, when the toner particles have a positive (+) polarity, the aluminum oxide is preferably surface-treated using distearyl di-methyl ammonium chloride such that the aluminum oxide has the positive polarity.

In addition to the aforementioned items, the toner composition of the present invention may include a variety of additives for the enhancement of functionality. For example, the toner composition may include UV stabilizer, mildewcide, bacteriocide, fungicide, anti-static agent, gloss modifier, oxidation-preventive agent, anticaking agent such as saline- or silicon-modified silica particles and the like as an external additive or an internal additive.

The present invention will now be described in detail with reference to the embodiments and the comparative examples.

EXAMPLES

Example 1

Production of Toner Particles (Pulverization Type Negative Toner)

Polyester 90.0 wt %

Carbon black 5 wt %

Negative type charge control agent (Iron-complex, made by HODOGAYA COMPANY LTD.) 2.5 wt %

Low molecular polypropylene wax 2 wt %

The ingredients were uniformly and preliminarily mixed in the amounts specified above using a HENSCHEL type mixer to obtain a mixture, and then the mixture was loaded in a biaxial extruder to extrude a melt mixture at the temperature of 130° C. Next, the extruded melt mixture was cooled and solidified. After that, toner particles with an average diameter of about 8 μm corresponding to a pre-stage of an external addition were obtained from the solidified mixture using a milling machine/classifier.

Surface Treatment of Aluminum Oxide

Alumina particles were produced by a high concentration precipitation-gelation method. After that, surface treatment agent was added to the alumina particles, and then the mixture of the surface treatment agent and the alumina particles was surface-treated by a mechanical milling. In the case of a negative aluminum oxide, lauryl sulfate was used as the surface treatment agent. In the case of a positive aluminum oxide, distearyl di-methyl ammonium chloride was used.

Production of Toner Composition

A toner composition was produced using the prepared toner particles, the surface-treated aluminum oxide, and the external additives cited below:

Positive silica (Primary particle size ranging from about 30 nm to about 50 nm) 0.5 wt %

Negative silica (Primary particle size ranging from about 7 nm to about 16 nm) 1.5 wt %

Sodium titanate (Primary particle size ranging from about 50 nm to about 150 nm) 0.5 wt %

Aluminum oxide (Primary particle size ranging from about 10 nm to about 100 nm) 0.5 wt %

Example 2

Production of Toner Composition

A toner composition was produced using the non-surface treated toner particles prepared in the EXAMPLE 1, the surface-treated aluminum oxide, and the external additives cited below:

Positive silica (Primary particle size ranging from about 30 nm to about 50 nm) 0.5 wt %

Negative silica (Primary particle size ranging from about 30 nm to about 50 nm) 0.5 wt %

Negative silica (Primary particle size ranging from about 7 nm to about 16 nm) 1.5 wt %

Sodium titanate (Primary particle size ranging from about 50 nm to about 150 nm) 0.5 wt %

Aluminum oxide (Primary particle size ranging from about 10 nm to about 100 nm) 0.5 wt %

Comparative Example 1

Production of Toner Composition

A toner composition was produced using the prepared toner particles of the EXAMPLE 1, the surface-treated aluminum oxide, and the external additives cited below:

Positive silica (Primary particle size ranging from about 30 nm to about 50 nm) 0.5 wt %

Negative silica (Primary particle size ranging from about 30 nm to about 50 nm) 0.5 wt %

Negative silica (Primary particle size ranging from about 7 nm to about 16 nm) 1.5 wt %

Aluminum Oxide (Primary particle size ranging from about 10 nm to about 100 nm) 0.5 wt %.

Comparative Example 2

Production of Toner Composition

A toner composition was produced using the prepared toner particles of the EXAMPLE 1, and the below external additives:

Positive silica (Primary particle size ranging from about 30 nm to about 50 nm) 0.5 wt %

Negative silica (Primary particle size ranging from about 30 nm to about 50 nm) 0.5 wt %

Negative silica (Primary particle size ranging from about 7 nm to about 16 nm) 1.5 wt %

Sodium titanate (Primary particle size ranging from about 50 nm to about 150 nm) 0.5 wt %.

Test

The toner compositions produced according to the EXAMPLES 1 and 2, and the COMPARATIVE EXAMPLES 1 and 2 were developed under the following developing condition and compared.

Developing Condition

Surface potential ($V_0$): −700 V

Latent image potential ($V_L$): −100 V

Developing roller application voltage: $V_{P-P}$=1.8 KV, frequency=2.0 kHz

Vdc=−500 V, duty ratio=35% (Square wave)

Developing gap: 150 μm to 400 μm

Developing roller (1) Al Roller

Illuminance: Rz=1 to 2.5 (after nickel plating)

(2) Rubber Roller (Nitrile Butadiene Group Elastic Rubber Roller)

Resistance: $1\times10^5$ Ω to $5\times10^5$ Ω

Hardness: 50

Toner: Charge (q/m)=−5 μC/g to −30 μC/g (on a developing roller after passing through a layer control unit)

Toner amount per unit area=0.3 mg/cm$^2$ to 1.0 mg/cm$^2$

Image Test Result

The images obtained using the toner compositions of the EXAMPLES 1 and 2 and the COMPARATIVE EXAMPLES 1 and 2 were evaluated using a 20 ppm LBP printer under the developing condition specified above.

Image density, fog (background, contamination of non-image region), and dot reproductivity of the respective images were measured to evaluate performances of the respective toner compositions.

At this time, the image density was obtained by measuring the density of a solid pattern on a printed paper, the fog was obtained by measuring the density in non-image region on a photosensitive medium using a SPECTROEYE (made by GRETAGMACBETH COMPANY LTD.). The dot reproductivity was evaluated visually.

Image Density

The below Table 1 shows experimental data of the image density. In Table 1, the symbol '↗' represents that the image density is in excess of 1.3, the symbol 'Δ' represents that the image density is in a range of 1.1 to 1.3, and the symbol 'x' represents that the image density is less than 1.1.

TABLE 1

| Number of papers | Initial | 2000 | 4000 | 6000 | 8000 |
|---|---|---|---|---|---|
| Example 1 | ↗ | ↗ | ↗ | ↗ | Δ |
| Example 2 | ↗ | ↗ | ↗ | ↗ | Δ |
| Comparative Ex. 1 | ↗ | ↗ | ↗ | Δ | Δ |
| Comparative Ex. 2 | ↗ | ↗ | Δ | Δ | x |

As seen from Table 1, the toner compositions according to the Examples 1 and 2 showed effective image densities until the number of printed papers reached 6000, but showed that the image density was lowered when the number of printed papers reached 8000. In contrast, the toner composition according to the Comparative Example 1, which does not contain sodium titanate, showed that the image density was decreased when the number of printed papers reached 6000, and the toner composition according to the Comparative Example 2, which does not contain aluminum oxide, showed that the image density was decreased when the number of printed papers reached 4000 and was further decreased when the number of printed papers reached 8000. From the above results, like in the Examples 1 and 2 of the present invention, it is well known that the toner compositions including the external additives having a composition ratio according to the present invention may maintain the image density at a predetermined level in spite of use over an extended period of time.

Fog

The below Table 2 shows experimental data of the fog. In Table 2, the symbol '↗' represents that the fog is less than 0.14, the symbol 'Δ' represents that the fog is in a range of 0.15 to 0.16, and the symbol 'x' represents that the fog is in excess of 0.17.

TABLE 2

| Number of papers | Initial | 2000 | 4000 | 6000 | 8000 |
|---|---|---|---|---|---|
| Example 1 | ↗ | ↗ | ↗ | ↗ | Δ |
| Example 2 | ↗ | ↗ | ↗ | ↗ | ↗ |
| Comparative Ex. 1 | ↗ | ↗ | Δ | x | x |
| Comparative Ex. 2 | ↗ | ↗ | ↗ | ↗ | Δ |

As seen from Table,2, the toner compositions according to the Examples 1 and 2 showed that the formation of fog was not found for an extended period of time. In particular, it is known that less fog was formed in the toner composition according to the Example 2, which included negative silica having a large particle size and a small particle size rather than in the toner composition according to the Example 1.

Also, in the toner composition according to the Comparative Example 1, which does not include sodium titanate, the formation of fog did not start until the number of printed papers reached 4000. When the number of the printed papers reached 6000, the formation of fog was increased.

Dot Reproduction

The below Table 3 shows experimental data of the dot reproduction. In Table 3, the symbol '↗' represents that any problem is not generated by visual eyes, the symbol 'Δ' represents a normal state, and the symbol 'x' represents that a significant problem is generated.

TABLE 3

| Number of papers | Initial | 2000 | 4000 | 6000 | 8000 |
|---|---|---|---|---|---|
| Example 1 | ↗ | ↗ | ↗ | ↗ | Δ |
| Example 2 | ↗ | ↗ | ↗ | ↗ | Δ |
| Comparative Ex. 1 | ↗ | ↗ | ↗ | ↗ | Δ |
| Comparative Ex. 2 | ↗ | Δ | Δ | x | x |

As seen from Table 3, the toner compositions according to the Examples 1 and 2, and the Comparative Example 1 do not show a significant problem. However, the toner composition according to the Comparative Example 2, which does not contain aluminum oxide, showed that a decrease of the dot reproduction starts when the number of printed papers reached 2000, and a significant problem was caused when the number of printed papers reached 6000.

As described above, according to an embodiment of the present invention, silica having an opposite polarity to toner particles, silica having the same polarity as the toner particles, sodium titanate and aluminum oxide are added as external additives to a toner composition in predetermined weight ratios, thus improving the image density, suppression of generation of fog, and dot reproduction.

The foregoing embodiment and advantages are merely exemplary and are not to be construed as limiting the present invention. The present teaching may be readily applied to other types of apparatuses. Also, the description of the embodiments of the present invention is intended to be illustrative, and not to limit the scope of the claims, and many alternatives, modifications, and variations will be apparent to those skilled in the art. Hence, it would be appreciated by those skilled in the art that changes may be made in these embodiments without departing from the principles and spirit of the invention, the scope of which is defined in the claims and their equivalents.

What is claimed is:

1. A toner composition for an electrophotography image forming apparatus, comprising toner particles and external additives, the toner particles including a colorant, a charge control agent and a release agent with binder resins, wherein the external additives comprise a first silica having an opposite polarity to the toner particles, a second silica having the same polarity as the toner particles, a sodium titanate having the same polarity as the toner particles, and an aluminum oxide having the same polarity as the toner particles.

2. The toner composition of claim 1, wherein the first silica having an opposite polarity to the toner particles has a primary particle size ranging from about 30 nm to about 200 nm and is present in an amount of from about 0.1 wt % to about 3.0 wt % with respect to 100 wt % that is a total weight of the toner particles, and the second silica having the same polarity as the polarity of the toner particles has a primary particle size ranging from about 5 nm to about 200 nm and is present in an amount of from about 0.1 wt % to about 6.0 wt % with respect to 100 wt % that is the total weight of the toner particles.

3. The toner composition of claim 2, wherein the second silica comprises:

first particles having a primary particle size ranging from about 5 nm to about 30 nm, and which are present in an amount of from 0.1 wt % to 3.0 wt % with respect to 100 wt % that is a total weight of the toner particles, and second particles having a primary particle size ranging from about 30 nm to about 200 nm, and which are in an amount of about 0.1 wt % to about 3.0 wt % with respect to 100 wt % that is the total weight of the toner particles.

4. The toner composition of claim 2 or 3, wherein a weight ratio of the first particles having the primary particle size ranging from about 5 nm to about 30 nm to the first silica having the primary particle size ranging from about 30 nm to about 200 nm is less than 4.

5. The toner composition of claim 1, wherein the sodium titanate having the same polarity as the toner particles has a primary particle size ranging from about 0.05 μm to about 1 μm and is present in an amount of from about 0.1 wt % to about 2.0 wt % with respect to 100 wt % that is a total weight of the toner particles.

6. The toner composition of claim 1, wherein the aluminum oxide having the same polarity as the tonerparticles has a primary particle size ranging from about 5 nm to about 200 nm and is present in an amount of from about 0.1 wt % to about 2.0 wt % with respect to 100 wt % that is a total weight of the toner particles.

7. The toner composition of claim 1, wherein when the toner particles have a negative (−) polarity, the aluminum oxide is surface-treated by lauryl sulfate.

8. The toner composition of claim 1, wherein when the toner particles have a positive (+) polarity, the aluminum oxide is surface-treated by distearyl di-methyl ammonium chloride.

9. The toner composition of claim 1, wherein the binder resins are selected from the group consisting of a styrene, including polystyrene and polyvinyl toluene, a single polymer of a derivative of the styrene, a styrene copolymer including styrene-acryl copolymer, polyethylene, polypropylene, a vinyl chloride-based resin, a polyacrylate, a polymethacrylate, a polyester, a polyacrylonitrile, a melamin resin, an epoxy resin and mixtures thereof.

10. The toner composition of claim 1, wherein the binder resins in the toner composition are present in an amount of from about 80 weight percent to about 98 weight percent with respect to 100 weight percent that is a total weight of the toner particles.

11. The toner composition of claim 1, wherein the colorant is a pigment type colorant exhibiting effective properties in thermal stability and resistance against light.

12. The toner composition of claim 11, wherein the pigment type colorant is selected from a group consisting of: a coloring organic pigment selected from the group consisting of an azo-based pigment, a phthalocyanine-based pigment, a basic dye-based pigment, a quinacridone-based pigment, a dioxacin-based pigment and a condensation azo-based pigment; a coloring inorganic pigment selected from the group consisting of a salt chromate, a perocyanide, an oxide, a sulfide, a selenite, a sulfate, a silicate, a carbonate, a phosphate, and a metal powder; and a black inorganic pigment including carbon black.

13. The toner composition of claim 11, wherein the pigment type colorant is an organic pigment selected from the group consisting of a blue and/or green pigment including copper phthalocyanine, a metal-free phthalocyanine including a pigment blue (P.B.) 15, 15:1, 15:2, 15:3, 15:4, 15:6, 16, a phthalocyanine having aluminum (Al), nickel (Ni) or vanadium (V) as a core metal, and breezed phthalocyanine polymer/oligomer including a Si-breezed phthalocyanine; an orange pigment including P.O. 5, 13, 42, 71, and 72; a pigment yellow including P.Y. 12, 13, 17, 74, 83, 93, 146, 155, 180, and 185; a pigment red including P.R. 48, 57, 122, 146, 147, 176, 184, 186, 202, 207, 238, 254, 255, 269, 270, and 272; and a mixture pigment including P.V. 19/P.R. 122 and P.R. 146/147.

14. The toner composition of claim 11, wherein the toner composition includes the pigment type colorant in an amount of from about 1 wt % to about 10 wt % with respect to 100 wt % that is a total weight of the toner particles.

15. The toner composition of claim 1, wherein the charge control agent has a negative (−) or a positive (+) polarity, and wherein the charge control agent with the negative polarity is selected from the group consisting of azo-based pigments and compounds of salicylic acid containing a metal element including Cr, Fe or Zn, and the charge control agent with the positive polarity is selected from the group consisting of nigrosine compounds, quaternary ammonium salts, and triphenylmethane derivatives.

16. The toner composition of claim 1, wherein the release agent is selected from the group consisting of low molecular polyolefins, silicons having a softening point by heating, fatty acid amide, and wax.

17. The toner composition of claim 16, wherein the wax is selected from the group consisting of carnauba wax, vegetable wax including bayberry wax and animal natural wax including beeswax, shellac wax, and spermaceti wax, mineral wax including montan wax, ozokerite wax, and ceresin wax, synthetic wax including paraffin wax, microcrystalline wax, polyethylene wax, polypropylene wax, acrylate wax, fatty acid wax, silicon wax, polytetrafluoreothyene wax and mixtures thereof.

18. The toner composition of claim 16, wherein the wax is present within an amount of from about 0.1 wt % to about 10 wt % per 100 wt % of the toner particles.

19. The toner composition of claim 16, wherein the toner composition further comprises at least one of a UV stabilizer, a mildewcide, a bacteriocide, a fungicide, an anti-static agent, a gloss modifier, an oxidation-preventive agent, or an anti-caking agent including saline- or silicon-modified silica particles as an external additive or an internal additive.

* * * * *

UNITED STATES PATENT AND TRADEMARK OFFICE

CERTIFICATE OF CORRECTION

PATENT NO. : 7,393,621 B2
APPLICATION NO. : 11/147377
DATED : July 1, 2008
INVENTOR(S) : Duck-hee Lee et al.

It is certified that error appears in the above-identified patent and that said Letters Patent is hereby corrected as shown below:

Column 11, Line 42, change “tonerparticles” to --toner particles--.

Column 11, Line 60, change “melamin” to --melamine--.

Column 12, Line 53, change “polytetrafluoreothyene” to --polytetrafluoroethylene--.

Signed and Sealed this

Fourth Day of November, 2008

JON W. DUDAS
*Director of the United States Patent and Trademark Office*